US007403210B2

(12) United States Patent
Hsieh et al.

(10) Patent No.: US 7,403,210 B2
(45) Date of Patent: Jul. 22, 2008

(54) DISPLAY MODE MANAGEMENT SYSTEMS AND METHODS

(75) Inventors: Ping-Huei Hsieh, Taipei (TW); Chia-Ling Wu, Taipei (TW)

(73) Assignee: VIA Technoologies, Inc., Hsin-Tien (TW)

( * ) Notice: Subject to any disclaimer, the term of this patent is extended or adjusted under 35 U.S.C. 154(b) by 18 days.

(21) Appl. No.: 11/263,418

(22) Filed: Oct. 31, 2005

(65) Prior Publication Data

US 2006/0214952 A1 Sep. 28, 2006

(30) Foreign Application Priority Data

Mar. 24, 2005 (TW) ..... 94109087 A

(51) Int. Cl.
*G09G 5/00* (2006.01)

(52) U.S. Cl. ..... 345/660; 345/661; 345/672

(58) Field of Classification Search ..... 345/660, 345/661, 672
See application file for complete search history.

(56) References Cited

U.S. PATENT DOCUMENTS 5,598,209 A * 1/1997 Cortjens et al. ..... 348/211.12
6,148,333 A * 11/2000 Guedalia et al. ..... 709/219
2002/0135605 A1* 9/2002 Kim ..... 345/698

FOREIGN PATENT DOCUMENTS

| | | |
|---|---|---|
| CN | 1375815 | 9/2006 |
| JP | 2000305529 | 11/2000 |

* cited by examiner

*Primary Examiner*—Matthew C. Bella
*Assistant Examiner*—Mike Rahmjoo
(74) *Attorney, Agent, or Firm*—Thomas, Kayden, Horstemeyer & Risley

(57) ABSTRACT

Display mode management systems and methods. The system comprises a plurality of supported display modes, and a processing module. The processing module receives an expected display mode, and determines whether the expected display mode is among the supported display modes. If not, a specific display mode is selected from the supported display modes. The resolution of the specific display mode is smaller than and closest to that of the expected display mode among the supported display modes. The specific display mode is set as the display mode of a device.

6 Claims, 3 Drawing Sheets

DISPLAY MODE MANAGEMENT SYSTEMS AND METHODS

BACKGROUND

The present disclosure relates generally to display management, and, more particularly to display mode management systems and methods that select appropriate display modes.

Display devices, such as monitors supporting display data channel (DDC) provide several display modes. When a device such as a computer system needs to change the display mode of the device, the computer system can retrieve display modes supported by the device from extended display identification data (EDID) via an operating system or a driver.

FIG. 1 is a flowchart of a conventional display mode management method. When a user wants to change the display mode of a display device, in step S110, an expected display mode is received. In step S120, the computer system determines whether the expected display mode exceeds the maximum resolution of the display device. If so (Yes in step S120), in step S130, a panning mode is executed according to the expected display mode and a display mode corresponding to the maximum resolution of the display device. FIG. 2 is a schematic diagram illustrating an example of a panning mode. In this example, the maximum resolution of the display device is 1280*1024, the expected display mode is 1600*1200, and region A is the area covered by the maximum resolution 1280*1024 of the display device. In the panning mode, the display mode of the display device is set to the maximum resolution thereof, and the area outside the maximum resolution, such as region B in FIG. 2, forms a virtual screen. A user can move a pointing device to view the virtual screen.

The panning mode is a well known technique, and description thereof is omitted here. If not (No in step S120), in step S140, the expected display mode is set as the display mode of the display device.

It is understood that the conventional display mode management method does not determine whether the expected display mode is supported by the display device. If the expected display mode does not exceed the maximum resolution of the display device, and is not supported by the display device, data displayed on the display device may be skewed, or even not appear.

SUMMARY

Display mode management systems and methods are provided.

An exemplary embodiment of a display mode management system comprises a plurality of supported display modes, and a processing module. The processing module receives an expected display mode, and determines whether the expected display mode is one of the supported display modes. If not, one specific display mode is selected from the supported display modes. The specific display mode is set as the display mode of a device. The resolution of the specific display mode is smaller than and closest to that of the expected display mode among the supported display modes.

In an exemplary embodiment of a display mode management method, an expected display mode is received. It is determined whether the expected display mode is supported by a device. If not, a specific display mode is selected from a plurality of display modes supported by the device. The resolution of the specific display mode is smaller than and closest to that of the expected display mode among the supported display modes. The specific display mode is set as the display mode of the device.

Display mode management methods may take the form of program code embodied in a tangible media. When the program code is loaded into and executed by a machine, the machine becomes an apparatus for practicing the disclosed method.

DESCRIPTION OF THE DRAWINGS

The invention will become more fully understood by referring to the following detailed description with reference to the accompanying drawings, wherein.

DESCRIPTION

Display mode management systems and methods are provided.

Figure 1:
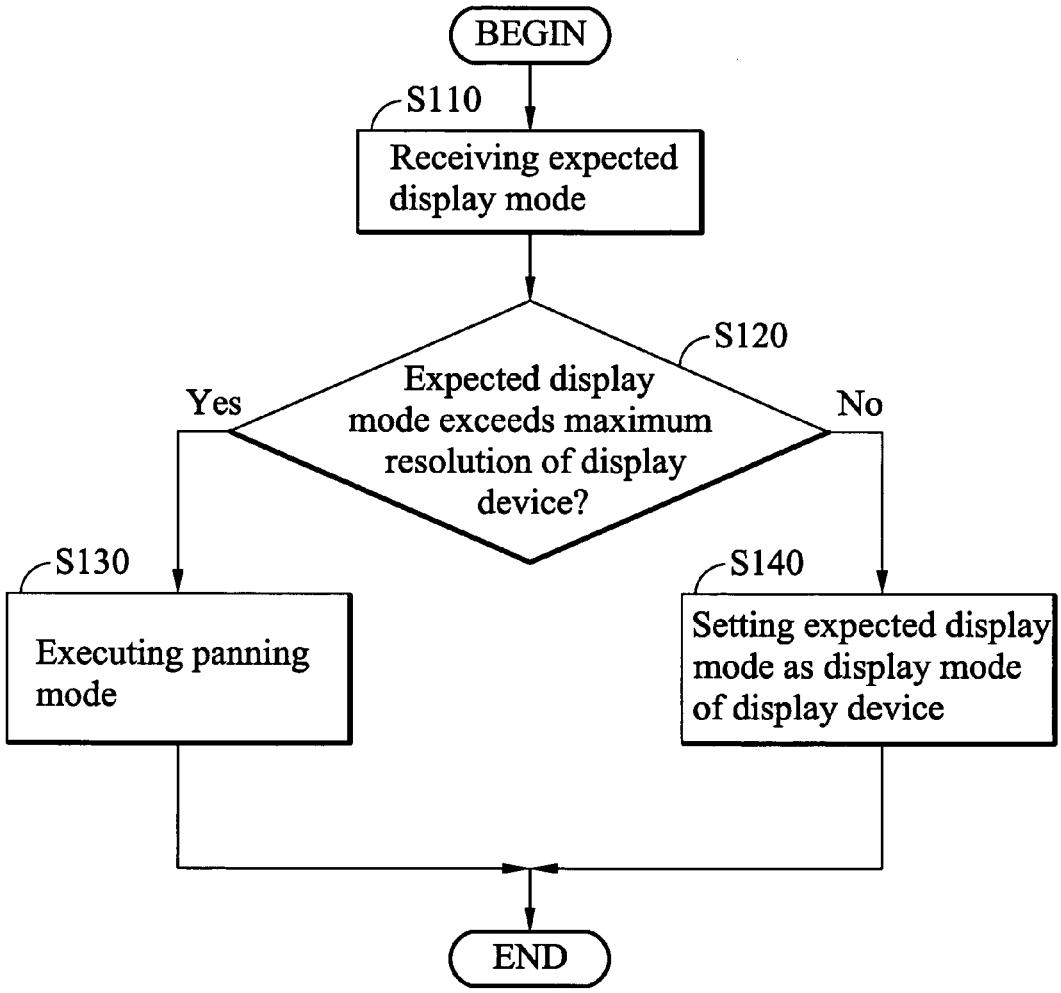
FIG. 1 ( RELATED ART )
FIG. 1 is a flowchart of a conventional display mode management method.
Figure 2:
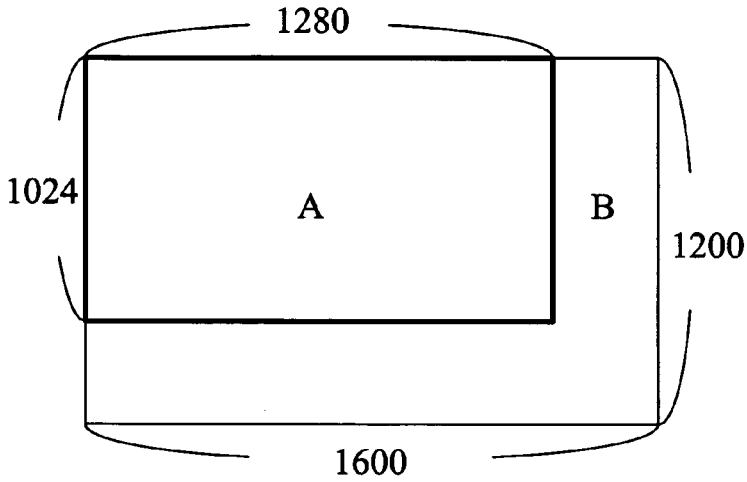
FIG. 2 ( RELATED ART )
FIG. 2 is a schematic diagram illustrating an example of a panning mode.
Figure 3:
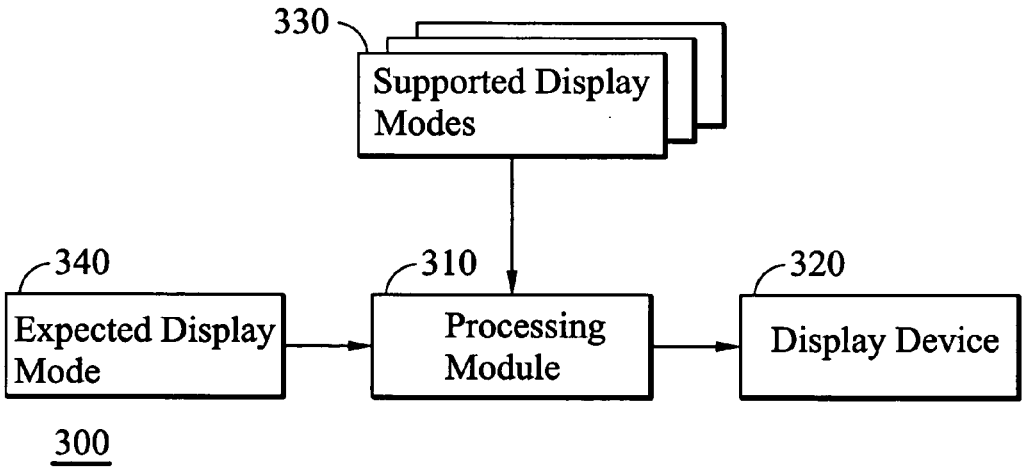
FIG. 3 is a schematic diagram illustrating an embodiment of a display mode management system.

FIG. 3 is a schematic diagram illustrating an embodiment of a display mode management system.

The display mode management system 300 comprises a processing module 310, a display device 320, and a plurality of supported display modes 330 supported by the display device 320. The display device 320 can be a monitor supporting DDC (Display Data Channel). The supported display modes 330 can be recorded in the EDID (Extend Display Identification Data). To change the display mode of the display device 320 by the processing module 310, an expected display mode 340 is received, and the display mode management of the invention is performed accordingly.

Figure 4:
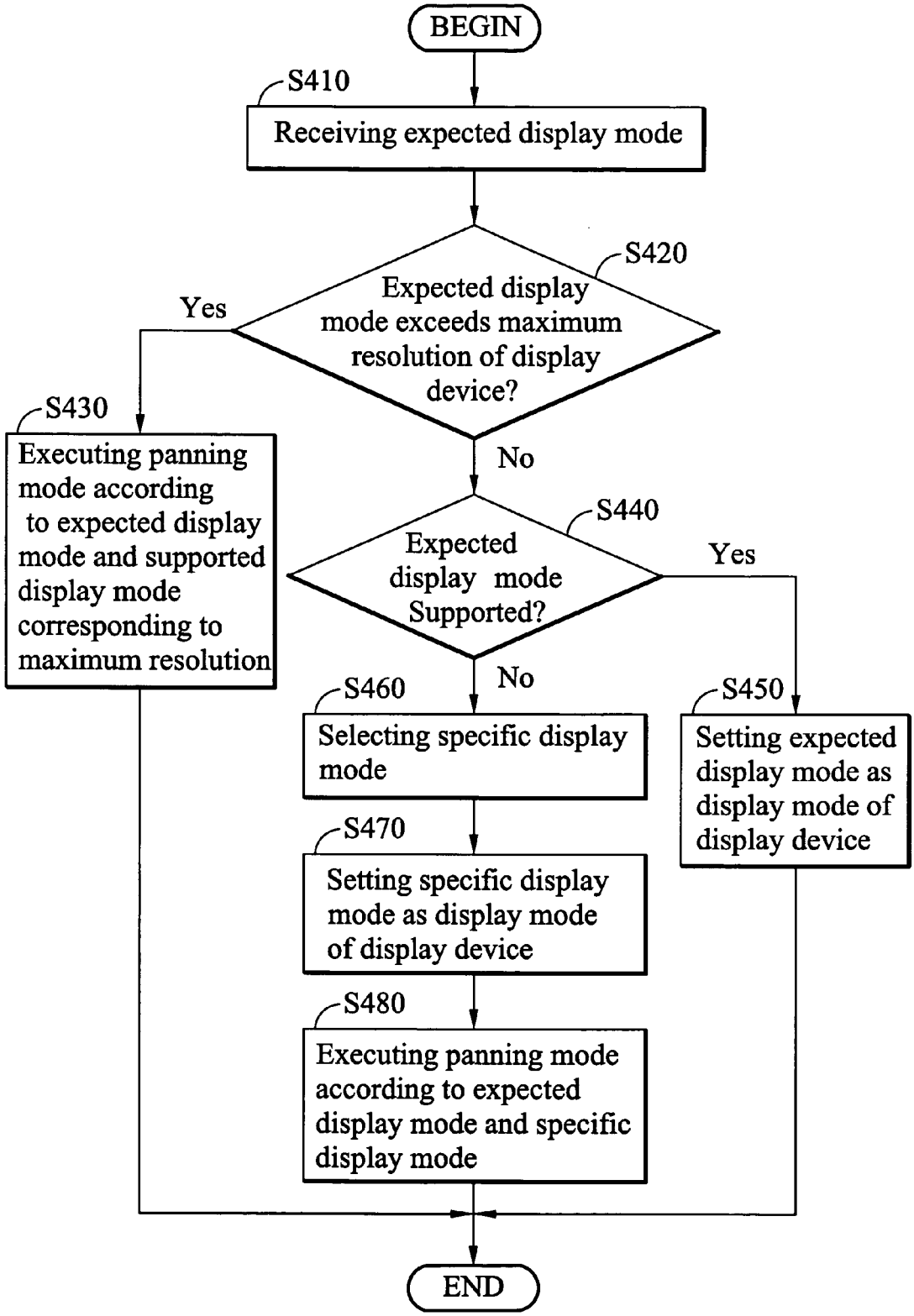
FIG. 4 is a flowchart showing an embodiment of a display mode management method.

FIG. 4 is a flowchart showing an embodiment of a display mode management method. To change the display mode of the display device 320, in step S410, an expected display mode is received. In step S420, the processing module 310 determines whether the expected display mode exceeds the maximum resolution of the display device 320. If so (Yes in step S420), in step S430, a panning mode is executed according to the expected display mode and a display mode corresponding to the maximum resolution of the display device 320. If not (No in step S420), in step S440, it is determined whether the expected display mode is supported by the display device 320. Note that step S440 is performed by checking whether the expected display mode is among supported display modes 330. If so (Yes in step S440), in step S450, the expected display mode is set as the display mode of the display device 320. If not (No in step S440), in step S460, a specific display mode is selected from the display modes 330 supported by the display device 320. The resolution of the specific display mode is smaller than and closest to that of the expected display mode among the supported display modes 330. For example, if the expected display mode is 1280*800, and the supported display modes comprise 1600*1200 1024*768, 800*600, and 640*480, display mode 1024*768 is selected as the specific display mode. In step S470, the specific display mode is set as the display mode of the display device 320, and in step S480, a panning mode is executed according to the expected display mode and the specific display mode.

Display mode management methods and systems, or certain aspects or portions thereof, may take the form of program code (i.e., executable instructions) embodied in tangible media, such as floppy diskettes, CDs, hard drives, or any other machine-readable storage medium, wherein, when the program code is loaded into and executed by a machine, such as a computer, the machine thereby becomes an apparatus for practicing the methods. The methods may also be embodied in the form of program code transmitted over some transmission medium, such as electrical wiring or cabling, through fiber optics, or via any other form of transmission, wherein, when the program code is received and loaded into and executed by a machine, such as a computer, the machine becomes an apparatus for practicing the disclosed methods. When implemented on a general-purpose processor, the program code combines with the processor to provide a unique apparatus that operates analogously to application specific logic circuits.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A display mode management system for a device displaying a video signal, comprising:

a device receiving a setting of a first display mode when a display mode of the device is changed;

a plurality of supported display modes of the device; and a processing module determining whether the first display mode is among the supported display modes, and, if not, selecting one specific display mode from the supported display modes, and setting the specific display mode as the display mode of the device, in which the resolution of the specific display mode is smaller than and closest to that of the first display mode among the supported display modes, and determining whether the first display mode exceeds the supported display mode having maximum resolution, and if so, executing a panning mode according to the first display mode and the supported display mode having maximum resolution, wherein in the panning mode, the display mode of the device is set to the supported display mode having maximum resolution, an area of the first display mode outside the coverage of the maximum resolution forms a virtual screen, and the virtual screen can be viewed by moving a pointing device, and outputting the video signal based on the specific display mode to the device for display.

2. The system of claim 1 wherein the processing module further executes a panning mode according to the first display mode and the specific display mode after the specific display mode is set as the display mode of the device.

3. The system of claim 1 wherein the processing module further sets the first display mode as the display mode of the device if the first display mode is among the supported display modes.

4. A display mode management method for use in a device displaying a video signal, comprising:

receiving a setting of a first display mode if a display mode of the device is changed;

determining whether the first display mode exceeds a supported display mode having maximum resolution of the device, and if so, executing a panning mode according to the first display mode and the supported display mode having maximum resolution, wherein in the panning mode, the display mode of the device is set to the supported display mode having maximum resolution, an area of the first display mode outside the coverage of the maximum resolution forms a virtual screen, and the virtual screen can be viewed by moving a pointing device;

determining whether the first display mode is supported by the device;

if not, selecting a specific display mode from the supported display modes supported by the device, in which the resolution of the specific display mode is smaller than and closest to that of the first display mode among the supported display modes, and setting the specific display mode as the display mode of the device; and outputting the video signal based on the specific display mode to the device for display.

5. The method of claim 4 further comprising executing a panning mode according to the first display mode and the specific display mode after the specific display mode is set as the display mode of the device.

6. The method of claim 4 further comprising setting the first display mode as the display mode of the device if the first display mode is among the supported display modes.

* * * * *